US005396990A

United States Patent [19]

Bell et al.

[11] Patent Number: 5,396,990

[45] Date of Patent: Mar. 14, 1995

[54] VERTICAL PACKAGING OF WEBBING ROLLS

[75] Inventors: Ronald E. Bell, Fairport; Benedict N. Daniels, Victor; Michael R. Eyre, Macedon, all of N.Y.; James R. Gavin, Temple, Tex.; Little David W., Fairport, N.Y.; Bruce M. Miles, Shortsville, N.Y.; David A. Schueler, Fairport, N.Y.

[73] Assignee: Mobil Oil Corporation, Fairfax, Va.

[21] Appl. No.: 267,990

[22] Filed: Jun. 29, 1994

[51] Int. Cl.[6] ..... B65D 85/672; B65D 85/66

[52] U.S. Cl. ..... 206/391; 206/398; 206/407

[58] Field of Search ..... 206/391, 393, 397, 398, 206/400, 407, 413, 416

[56] References Cited

U.S. PATENT DOCUMENTS

| | | | |
|---|---|---|---|
| 3,487,918 | 1/1970 | Roden et al. | 206/65 |
| 4,033,455 | 7/1977 | Robison | 206/391 |
| 4,036,418 | 7/1977 | Chlebda | 206/391 |
| 4,516,677 | 5/1985 | Rowland et al. | 206/394 |
| 4,967,907 | 11/1990 | Pozzi | 206/391 X |
| 4,998,619 | 3/1991 | Sowa et al. | 206/392 |
| 5,100,076 | 3/1992 | Cobane et al. | 206/416 X |
| 5,346,065 | 9/1994 | Dunbar et al. | 206/391 X |
| 5,351,825 | 10/1994 | Duffy | 206/413 X |

FOREIGN PATENT DOCUMENTS 0067656 12/1982 European Pat. Off. .

*Primary Examiner*—Jacob K. Ackun
*Attorney, Agent, or Firm*—Alexander J. McKillop; Malcolm D. Keen; Clinton H. Hallman, Jr.

[57] ABSTRACT

The invention relates to a system for the vertical packaging of webbing rolls. The system consists of a tier of webbing rolls consisting of a bottom tray, a plurality of webbing rolls positioned thereon, each roll enclosed within a cushioning sleeve and a top cap. The system components are preferably fabricated from corrugated material which has inherent cushioning characteristics and serves to deflect any damaging shipping impacts.

9 Claims, 6 Drawing Sheets

VERTICAL PACKAGING OF WEBBING ROLLS

FIELD OF THE INVENTION

The invention relates to a system for the vertical packaging of webbing rolls,

BACKGROUND OF THE INVENTION

The present invention relates to a system for the vertical packaging of webbing rolls. Webbing rolls are wound rolls of film, sheet or other material that for the purposes of this invention must be shipped from point of manufacture to an end user at a distant destination. The webbing material can be paper, plastic film, yarn or the like.

No matter what the material is shipped, there have been recurring problems with damage to the webbing material during transit. This damage is often encountered during shipment by common carrier. As an example, stretch wrap film is typically shipped in multi-roll unitized loads having the rolls positioned horizontally in the load. Plastic foam cradles support the rolls at each end. This packaging method has been troublesome for a number of reasons. The horizontal arrangement creates an odd-sized load requiring that a non-standard pallet be used for shipment. These non-standard pallets cannot be reused and are an expensive item for the end user to dispose of properly. Moreover, the plastic cradles cannot be reused and can be extremely difficult to recycle. The cradles, though light, are bulky and expensive to manufacture and ship. Yet another problem with the horizontal cradle method is that the stretch wrap film load is subject to damaging impact during shipment. The cradles provide inadequate protection from such impacts so that the film is subject to nicks, tears, or abrasions that can penetrate several layers of the roll. The film can be weakened to the point that when put to use and stretched to well over 100% of its original length catastrophic failures can result. These failures reduce customer confidence in the product and cause expensive down time while the problem is corrected. Also the damaged portion of the film must be discarded effectively reducing the amount of useable film available from a full roll and indirectly increasing the cost to use the film.

Several methods are known to address the problem of film packaging for transport. U.S. Patent No. 4,033,455 to Robison describes a container for the storage and shipment of plastic sheet or film. The container has three sides and at least one end with a plurality of openings therein adapted for an end of each roll to be held in place. At the opposing bottom end the rolls are supported by a plurality of rows of cut-off, cone-shaped, knob-like upper extensions. The invention states that metal is preferably used for the sides and braces of the container.

Roden et al. U.S. Pat. No. 3,487,918 describes a method of packaging thermal candles. The candles are poured into containers arranged in a tier on a pallet. As each tier of candles cools, it is used as the support means for the next tier of candles. The multiple tiers are strapped with banding material to form a load.

Rowland et al. U.S. Pat. No. 4,516,677 describes a modular pallet and shipping tray for the shipping of yarn. The pallet is manufactured from high density polyethylene. It includes top and bottom surfaces having a repeating pattern of nubs upstanding from the top surface and a repeating pattern of depressions in the bottom surface. The nubs receive one end of the tubular core of the yarn rolls.

EPO application 0 067 656 describes a method of packaging rolls of polyvinyl butyral film between retainers which engage the ends of the roll cores. The invention uses frusto-conical retainer plugs located on an end member by an aperture sheet. The plugs have circumferential flanges and extend through the aperture sheet into the roll cores. The weight of the rolls is thus supported by the plugs on the flanges. Plugs and an aperture sheet are used in each end of the rolls of film.

Sowa et al. U.S. Pat. No. 4,998,619 describes a shipping packaging system with at least one tier of vertically-stacked webbing rolls. The system utilizes pads having an inner set and an outer set of passages therein. The tubular core ends of the webbing rolls are intended to nest in the passages. The outer set of passages accommodates radial webbing roll movement and inhibits circumferential movement about the pad center.

Each of these inventions has disadvantages for long distance shipping of webbing rolls. Any kind of insert or plug used in the roll core will tend to become firmly lodged therein during shipment and could be quite difficult to remove when received by the end user. This problem would be particularly acute with vertically packaged rolls because the plug or insert would be driven into the roll core during shipment by the weight of the roll. Using a horizontal shipping position would address that problem but could lead to the odd-sized pallet problem described herein above.

Additionally, the polyethylene pallet of the '677 patent to Rowland et al. adds a great deal of weight to the load. The use of that pallet requires the inventory and storage of the pallet members causing increased administrative work and expense.

There remains a need for a packaging system which is lightweight, provides protection to individual rolls and does not require the expensive handling of pallet components. Preferably such a packaging system would use components of standard size which could be disposed of quickly and at low cost.

SUMMARY OF THE INVENTION

According to this invention a system for the vertical packaging of webbing rolls is provided comprising at least one tier of vertical webbing rolls, the tier comprising a bottom tray and a plurality of webbing rolls. Each roll has a rigid center core extending beyond each end of the webbing material and resting on the bottom tray so as to support the webbing roll. The webbing material is maintained a spaced distance from the bottom tray. There is also provided a plurality of cushioning sleeves having a height equal to that of the rigid center core, each of the sleeves surrounds one of the webbing rolls and rests on the bottom tray. A top cap is positioned atop the webbing rolls in contact with and supported by the rigid center cores and the sleeves, so that the webbing material is maintained a spaced distance from the top cap.

The present invention relates to an adaptable, lightweight, protective packaging system for vertical webbing rolls. The system offers the advantages of providing individual cushioning sleeves for each roll of a load of webbing rolls. The sleeves prevent roll to roll contact and also minimize or eliminate the damage from impact to the load during shipment from place of manufacture to a distant point. The system provides for the roll cores to carry the weight of the webbing material so that the packaging material can be fabricated of a lighter material than otherwise might be the case. The preferred material for the sleeves bottom tray and top cap is corrugated paper which provides the required cushioning. Corrugated material is lightweight, easy to fabricate and can be recycled readily.

Therefore it is an object of this invention to provide a packaging system for webbing rolls that significantly reduces shipment damage to the webbing material contained thereon.

It is a further object of this invention to provide a lightweight packaging system that provides individualized protection for each of a plurality of webbing rolls making up a unitized load.

It is still another object of this invention to provide a packaging system that uses recyclable packaging material.

The invention itself, together with further objects and attendant advantages, will best be understood by reference to the following detailed descriptions, taken in connection with the accompanying drawings.

DETAILED DESCRIPTION OF THE INVENTION

Figure 1:
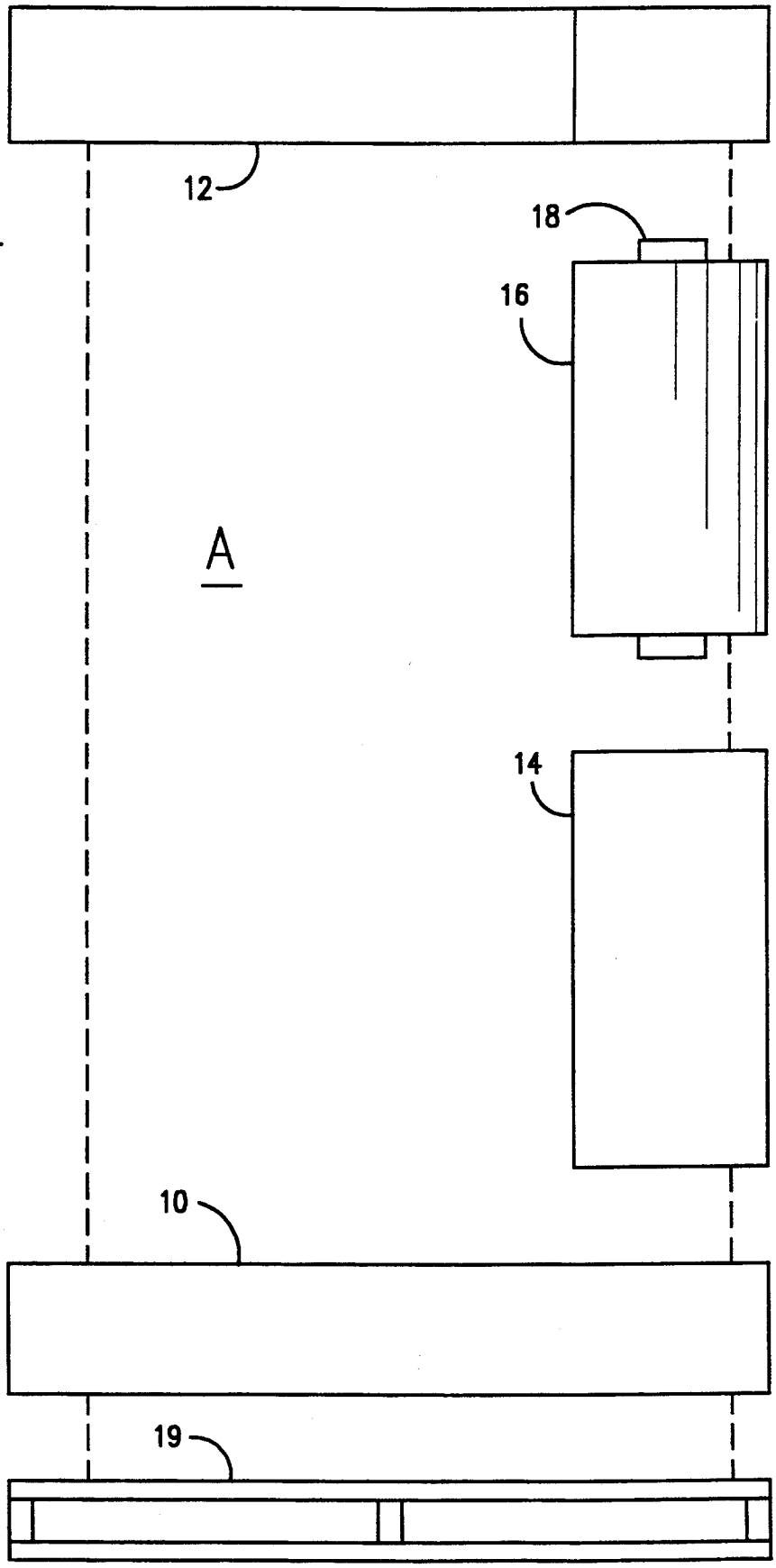
FIG. 1 is an exploded elevation view of one tier of the vertical packaging system of the present invention.
Figure 1A:
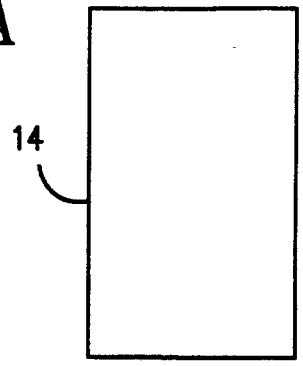
FIG. 1A is an elevation of a square-shaped embodiment of the webbing roll sleeve.
Figure 1B:
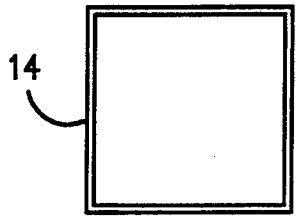
FIG. 1B is a section of the square-shaped embodiment of the webbing roll sleeve.
Figure 1C:
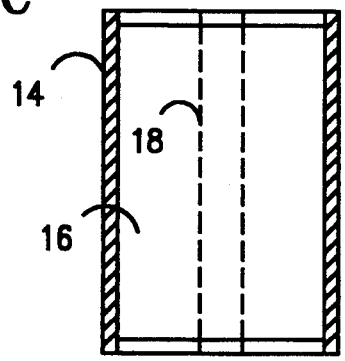
FIG. 1C is an elevation of a square-shaped embodiment of the webbing roll sleeve showing the webbing roll disposed within.

Turning now to FIG. 1 it can be seen that the present invention comprises a tier A containing a bottom tray 10 which has a flat bottom and four upstanding walls. The bottom tray 10 holds a plurality of webbing rolls 16, each of which are enclosed within a cushioning sleeve 14. The tier A is completed by a top cap 12 having a flat surface and four downwardly projecting walls. The top cap is supported by the webbing roll center cores 18 as described herein below.

The bottom tray 10 can contain a plurality of vertical rolls 16, but for clarity only one such roll is pictured. The present invention is intended for use with rolls having a rigid central core 18 which extends beyond the top and bottom of the wound material. This extension is important because the core rests on the bottom tray 10 and carries the weight of the roll 16. No matter what webbing material is carried on the roll, the roll core must have sufficient strength to support the weight of at least one roll of material. The roll core must further be able to support additional tiers of webbing rolls as described herein below.

Also resting on the bottom tray 10 and enclosing the roll of webbing material 16 is a cushioning sleeve 14. The sleeve 14 serves to protect each roll 16 from impact by forming an individualized protective zone therefor. It is critical to the function of the sleeve that it be of the same length or height as the webbing roll core 18. A sleeve height shorter than the core height will adversely affect tier stability and could permit the top cap, described below to dish in should a second tier be stacked atop a bottom tier. A sleeve height longer than the core height would waste material and cause the sleeve to carry an unintended share of the weight of a second tier.

Figure 4:
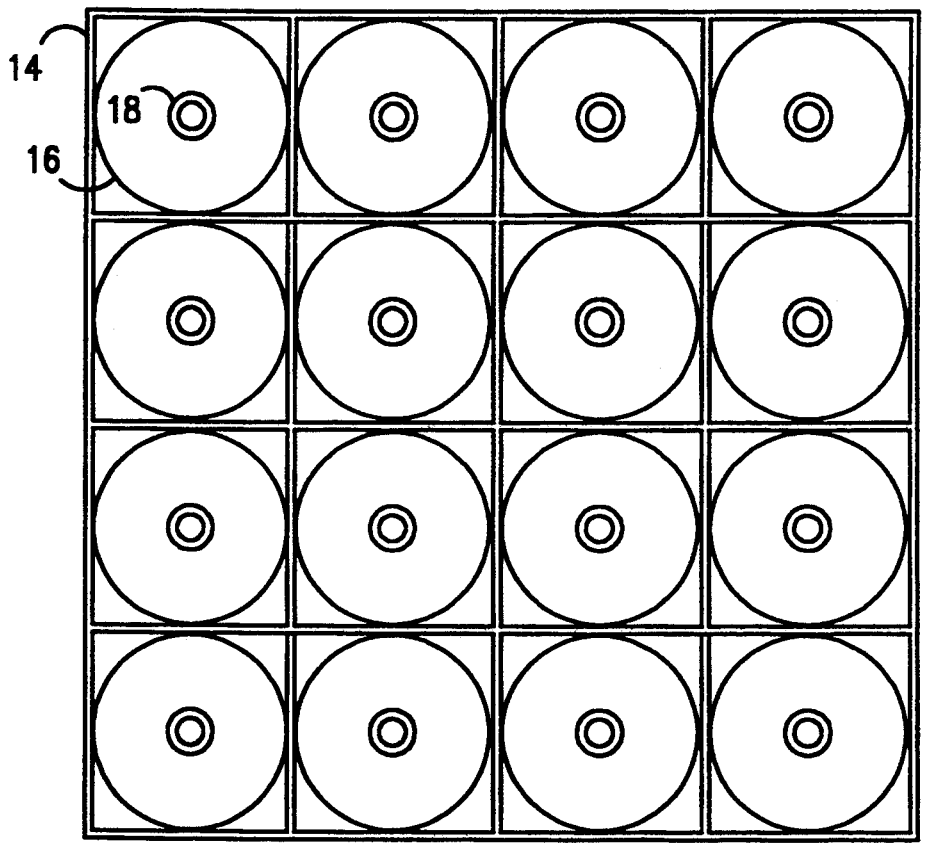
FIG. 4 is a view showing an arrangement of four rows of four rolls of webbing material contained within square-shaped sleeves.

In a nonlimiting example, FIG. 4 shows one method of arranging a plurality of rolls 16 enclosed in individual sleeves 14 on the bottom tray. The sleeves 14 are shown slightly separated for clarity. However, it will be obvious to one of ordinary skill in the art that during use the sides of the sleeves 14 touch and serve to separate and protect the individual webbing rolls 16. Thus the material in any one roll in the load will not contact the material in any other roll in the load. Moreover, the rolls of one load will not directly contact the rolls of an adjacent roll because at least some portion of each sleeve faces outwardly from the load to protect the webbing material.

Returning to FIG. 1, it can be seen that a top cap 12 completes the tier. The top cap 12 rests on both the roll core and the sleeve. In the embodiment shown in FIG. 1, the top cap 12 extends downwardly and the bottom tray 12 extends upwardly to a point about a third of the way from the top and bottom respectively of the sleeve. This extension can be increased, but any increase would result in an increased material requirement, cost and packaging weight without a corresponding benefit to load stability.

Figure 1D:
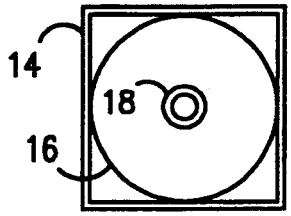
FIG. 1D is a section of a square-shaped embodiment of the webbing roll sleeve showing the webbing roll disposed within.
Figure 1E:
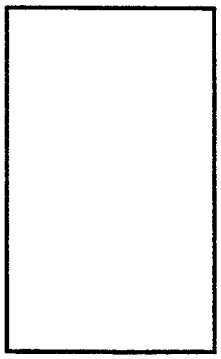
FIG. 1E is an elevation of a round embodiment of the webbing roll sleeve.
Figure 1F:
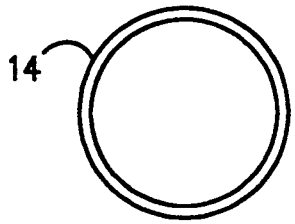
FIG. 1F is a section of a round embodiment of the webbing roll sleeve.
Figure 1G:
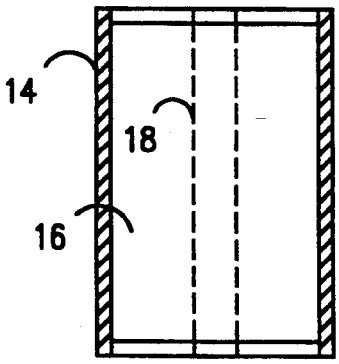
FIG. 1G is an elevation of a round embodiment of the webbing roll sleeve showing the webbing roll disposed within.
Figure 1H:
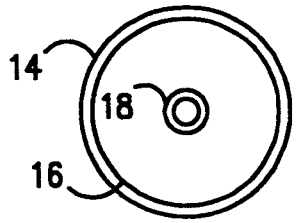
FIG. 1H is a section of a round embodiment of the webbing roll sleeve showing the webbing roll disposed within.

The sleeve 14 may be fabricated in any configuration which adequately protects the webbing roll. Just as many different shapes and sizes of webbing rolls can be shipped using this packaging system, many different sleeve embodiments can be used to protect the rolls. Two of a potentially large number of configurations are shown in FIGS. 1A through 1H. FIGS. 1A, 1B, 1C, and 1D show a square-shaped embodiment and FIGS. 1E, 1F, 1G, and 1H depict a round embodiment of the sleeve. Depending on which of the two is utilized, the roll contacts the sleeve either continuously around its circumference, as shown in FIG. 1H, or at four points along the roll circumference as shown in FIG. 1D. The inside dimension of the sleeve 14 should be slightly larger than the outside diameter of the roll of webbing material 16. By slightly larger it is meant that if the roll is inserted into the sleeve 14 and then picked up by the roll core, the sleeve 14 will slide off the roll. Particularly with respect to the square-shaped embodiment, the sleeve should be sized so that inserting the roll of webbing material does not cause the sides of the sleeve to bow out or bulge. While the round embodiment functions adequately, the square-shaped embodiment is particularly preferred because it better increases the overall rigidity and stability of the load. The square-shaped sleeve along with the bottom tray and top cap advantageously forms a highly damage resistant tier having continuous, flat, rigid, sides top and bottom. By highly damage resistant, it is not meant that the packaging system will resist catastrophic event such as a load being dropped from a height. However, the packaging system of the present invention will protect rolls of webbing material from normally encountered shipment damage to a significantly higher degree than previous packaging methods.

Figure 2:
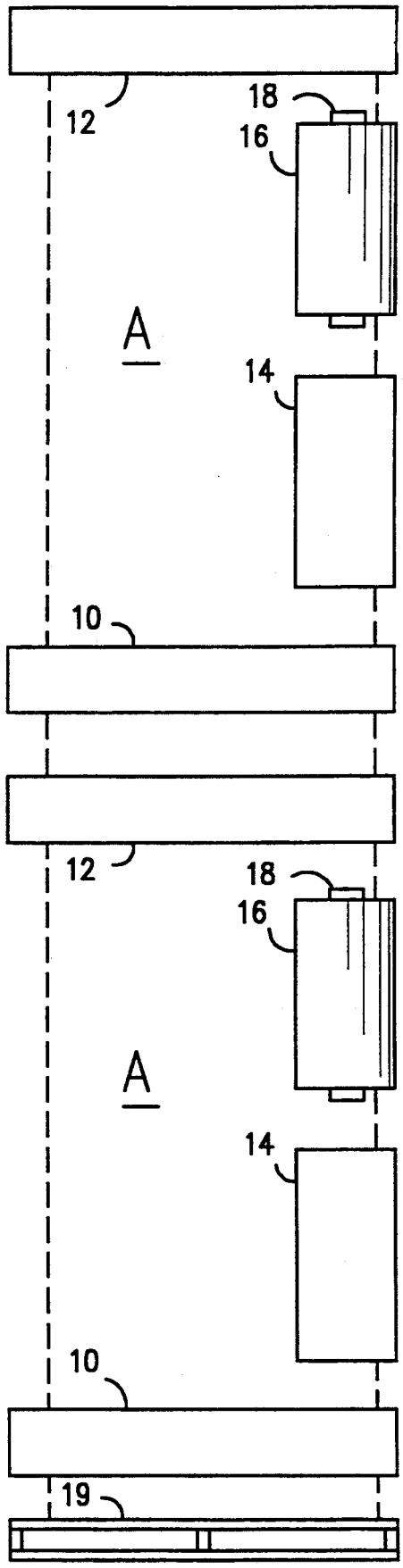
FIG. 2 is an exploded elevation of an embodiment of the present invention having two tiers.
Figure 5:
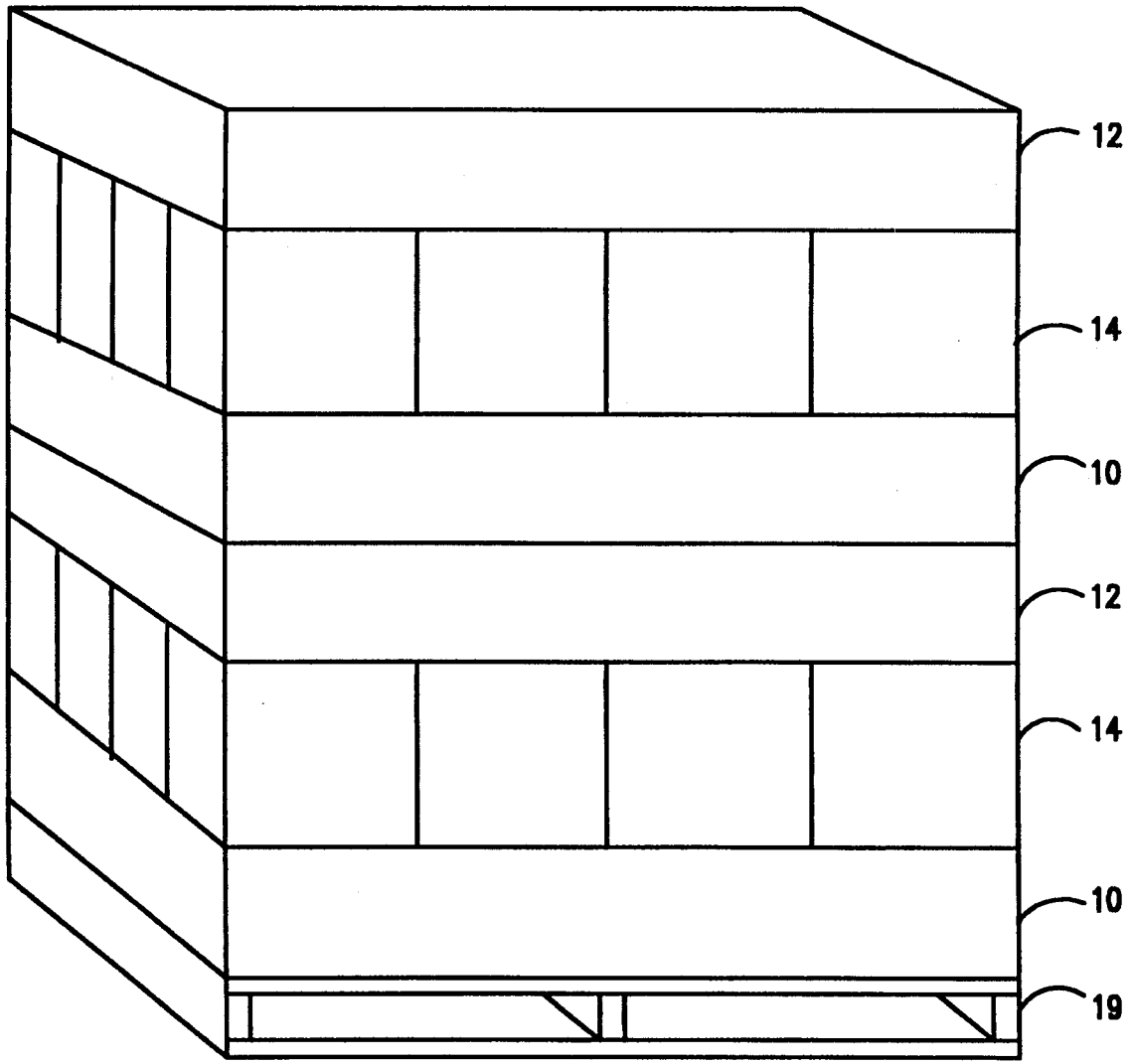
FIG. 5 is a perspective view of the present invention forming a unitized load.

The tier just described and pictured in FIG. 1 can be used either singly or in a modular fashion with a second tier as illustrated by the exploded view in FIG. 2. The number of webbing rolls in a tier and the number of tiers making up a unitized load will vary with the characteristics such as the weight and the dimensions of the rolls to be shipped. FIG. 5 illustrates a completely unitized load having two tiers. For shipment the load would be placed on a platform member such as a pallet so that material handling equipment may be used to warehouse the load. Although not shown in FIG. 5, the two tiers making up the load would be firmly secured to the platform member. This securing is preferably accomplished by use of plastic stretch wrap film. Use of plastic stretch wrap is well known for unitizing palletized loads. In one procedure, the load to be wrapped is positioned upon a platform, or turntable, which is made to rotate and in so doing, to take up stretch wrap film supplied from a continuous roll. Braking tension is applied so that the film roll is continuously subjected to a stretching or tensioning force as it wraps around the rotating load in overlapping layers. Generally, the stretch wrap film is supplied for a vertically arranged roll positioned adjacent to the rotating pallet load. Rotational speeds of from about 5 to 50 revolutions per minute are common. At the completion of the overwrap operation, the turntable is completely stopped and the film is cut and attached to an underlying layer of film employing tack sealing, adhesive tape, spray adhesives or the like. The unitized load consisting of at least one tier secured to the platform member is then ready for shipment.

Figure 3:
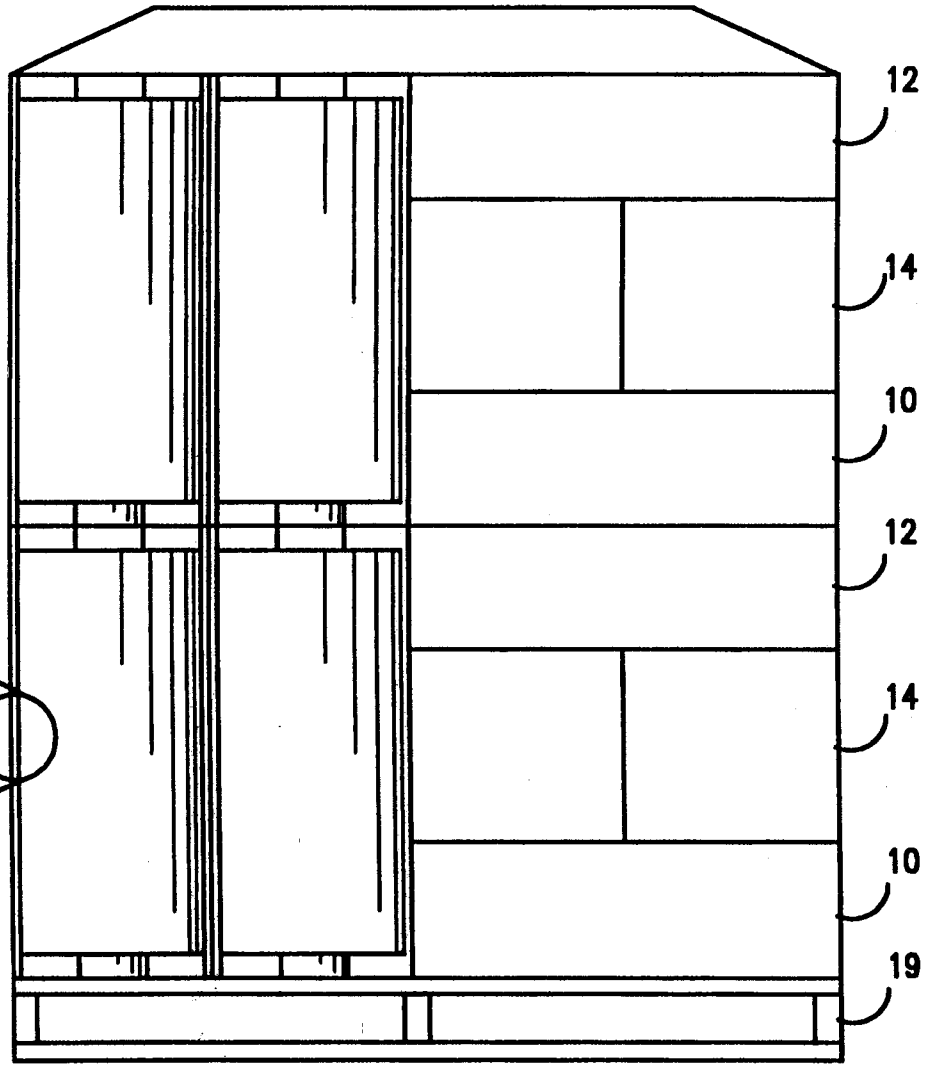
FIG. 3 is a perspective view of a two tier embodiment of the present invention with a cut away section to show the webbing rolls contained within.
Figure 3A:
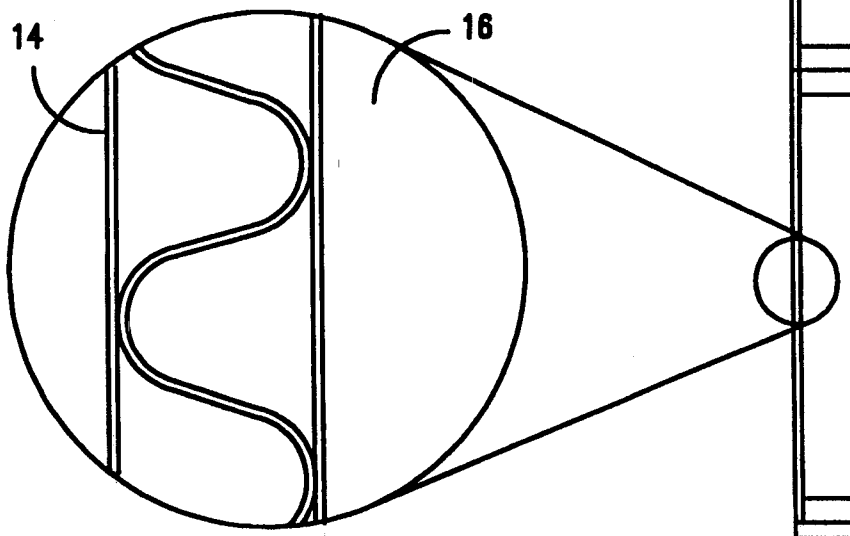

Another aspect of the protection afforded the load of webbing rolls is shown in FIG. 3 which is perspective view of the load having a partial cut away. It can be clearly seen that the rolls are in intimate contact with the sleeves. Most potentially damaging impacts will be deflected by the sleeves. The ends of the rolls of webbing material are protected by their spaced relationship with the bottom tray and the top cap. FIG. 3 shows that there is a space located at each end of the webbing rolls. This space is created by the extension of the roll core beyond the webbing material. The webbing material is thus maintained a spaced distance away from both the bottom tray and the top cap. FIG. 3 also shows that the roll cores of the bottom tier are in alignment with the roll cores of the top tier. Thus the entire weight of the load is carried by roll cores which are supported by the platform member. This feature of the packaging system allows the bottom tray, the sleeves and the top cap to be manufactured from a lighter material than otherwise might be the case because those items do not carry or support the weight of the load. As described above, the heavier the material making up the webbing rolls, the more substantial the construction of the roll center core 18 must be.

Lightweight materials having a cushioning property may be utilized for the present invention. Particularly preferred for forming the sleeves, bottom tray and top cap of the present invention is corrugated paper or paperboard. Corrugated material offers several advantages in this application. The structure of this material has inherent cushioning characteristics important to protecting the webbing rolls. Additionally, it weighs less than an equivalent amount of plastic cradle packaging material required for horizontally packaging the same number of rolls into a unitized load. Corrugated material is readily recyclable so that the end user's costs of disposal and volume of packaging material to be disposed are greatly reduced.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A system for the vertical packaging of webbing rolls comprising:

at least one tier of vertical webbing rolls, the tier comprising:

a bottom tray, a plurality of webbing rolls, each roll having a rigid center core, the core extending beyond each end of the webbing material and resting on the bottom tray so as to support the webbing roll such that the webbing material is maintained a spaced distance from the bottom tray, a plurality of cushioning sleeves, the sleeves having a height equal to that of the rigid center core, each of the sleeves surrounding one of the webbing rolls, said sleeves resting on the bottom tray;

a top cap positioned atop the webbing rolls in contact with and supported by the rigid center cores and the sleeves, wherein the webbing material is maintained a spaced distance from the top cap.

2. The packaging system of claim 1 further comprising a means for securing the at least one tier to a platform member.

3. The packaging system of claim 2 wherein the means for securing is a thermoplastic stretch wrap film.

4. The packaging system of claim 1 wherein the sleeves are composed of corrugated material.

5. The packaging system of claim 1 wherein the top cap and the bottom tray are composed of corrugated material.

6. The packaging system of claim 1 wherein the sleeves are square-shaped having four flat sides.

7. The packaging system of claim 6 wherein the at least one tier has continuous, substantially flat, rigid sides, top and bottom formed by the bottom tray, the sleeves, and the top cap.

8. The packaging system of claim 1 wherein the sleeve is round, the sleeve having an internal diameter slightly larger than an external diameter of the webbing roll.

9. The packaging system of claim 3 further comprising a second tier of vertical webbing rolls, the second tier positioned atop the at least one tier, the center cores of said second tier being in substantial alignment with the center cores of the at least one tier.

* * * * *